US005236389A

United States Patent [19]

Moreno Orduna

[11] Patent Number: 5,236,389

[45] Date of Patent: Aug. 17, 1993

[54] COIN COUNTER AND RETURN DEVICE

[76] Inventor: Carlos Moreno Orduna, Pº Sagasta, 15 - 6ºC, Zaragoza, Spain, 50008

[21] Appl. No.: 878,870

[22] Filed: May 5, 1992

[30] Foreign Application Priority Data

May 6, 1991 [ES] Spain ..... 9101110

[51] Int. Cl.[5] ..... G07D 1/00

[52] U.S. Cl. ..... 453/57; 221/203

[58] Field of Search ..... 453/30, 32-35, 453/49, 57; 221/203, 265

[56] References Cited

U.S. PATENT DOCUMENTS 4,902,263 2/1990 Ito et al. ..... 453/57 X
5,030,165 7/1991 Nilsson et al. ..... 453/57 X
5,074,824 12/1991 Suris ..... 453/57

FOREIGN PATENT DOCUMENTS 52-85895 7/1977 Japan ..... 453/33
2185341 7/1987 United Kingdom ..... 453/57

*Primary Examiner*—Michael S. Huppert
*Assistant Examiner*—William M. Hienz
*Attorney, Agent, or Firm*—Darby & Darby

[57] ABSTRACT

A coin counter and return device useful in automatic vending machines, amusement devices and slot machines, consisting of a fixed base upon which there is a rotating body and a plurality of projections. The rotating body has at least one contact face and has a plurality of recesses each of which is positioned to receive one of the projections. To remove a coin, the contact face knocks a coin against the projections and presses the coin against the projections at contact points separated by a distance less than the coin's diameter. This impels the coin towards the outside. In this way, coins of any dimension may be counted and returned.

4 Claims, 1 Drawing Sheet

COIN COUNTER AND RETURN DEVICE

OBJECT OF THE INVENTION

As is expressed in the title of the present specification, the following invention consists of a coin counter and return device, useful for all types of coins irrespective of the dimensions thereof.

The coin ejection mechanism can be incorporated, in rotary returning devices, in which coins are deposited in a disorganized manner in a hopper, as well as in vertical column returning devices in which the coins are stacked in a vertical column.

The coin ejection mechanism consists of a fixed base upon which the coins are deposited. An element projects from the base upon which the coins knock against. A rotary element also acts upon the coine causing the expulsion of the coin that knocks against the element projecting from the base. The rotary element and the element projecting from the base exert pressure on the coin such that the distance between their respective points of contact is smaller than the coin's diameter.

BACKGROUND OF THE INVENTION

Among coin rotary return devices consisting of a frame like a hopper, into which coins are deposited, a base, and an inclined rotating circular plate, we can mention those in which the circular plate has a plurality of perimetric recesses. In such devices, there are a series of stubs with a specific distance between them, arranged in such a way that between each two continuous stubs, a coin is housed in order to be lead to the outlet.

In connection with the outlet there is a strip acting as a remover, likewise having a counter, to count the coins returned.

In this way, such returning devices can solely and exclusively return coins of specific dimensions, in order to be able to operate normally. Thus, in the event there are coins of the same value and different size, only coins with specific dimensions can be returned. In such devices, a coin of an identical value and different size must be led to a second returning device or definitive moneybox.

In the case of returning devices in which the coins remain stacked in a vertical hollow cylindrical body and are removed through the bottom part thereof, the same problem arises, since the diameter of the hollow cylindrical body must be similar to the size of the coin housed, so that there is no jamming.

Thus, if the diameter of the body in which the coins are deposited is somewhat larger than that of the coins, logical jams may result.

The coin counter and return device that is described in the present specification, is useful in rotary return devices, as well as fixed column ones, to return coins. All types of coins can be returned and counted irrespective of the dimensions thereof.

In a rotary returning device in which coins remain spread out in a storage hopper, and the device itself remains inclined, the device formed by a fixed circular base from which a small strip or series of aligned pivots and a rotating body project in a radial position with regard to the shaft of the circular fixed base.

The cited rotating body can have different shapes, and thus can be a radial element, diametric or star-shaped element, with a variable number of tips, in such a way that for each complete rotation a different number of coins can be removed depending on the shape thereof.

The removal is occurs when the coin knocks against the projection of the fixed base and the rotating body, producing the removal through a hole.

This contact upon the coin is done in such a way that the stresses exerted upon the coin cause a resultant force that results in the removal thereof. A strip may be positioned in the hole and connected to a counter or other device to count the coins passing through the hole.

In order to permit the correct operating of the rotating element, the same is provided with some recesses on a surface facing the base each positioned to receive one of the pivots as the rotating element rotates.

In the event that the device is incorporated for the return of coins stacked in a fixed vertical body, the same is formed by a rotating body that will knock against the lowest coin and remove it in the same way described above.

When jamming takes place, after a certain amount of time has past, a retraction impulse upon the rotating body causes the unblocking.

In this way the device can be used without any modification for the return and counting of all types of coins.

In order to complement the description that is going to be made hereinafter and for the purpose of providing a better understanding of the features thereof, the present specification is accompanied by a set of drawings in whose figures the most significant details of the invention are represented in an illustrative and nonrestrictive manner.

DESCRIPTION OF A PREFERRED EMBODIMENT

Figure 1:
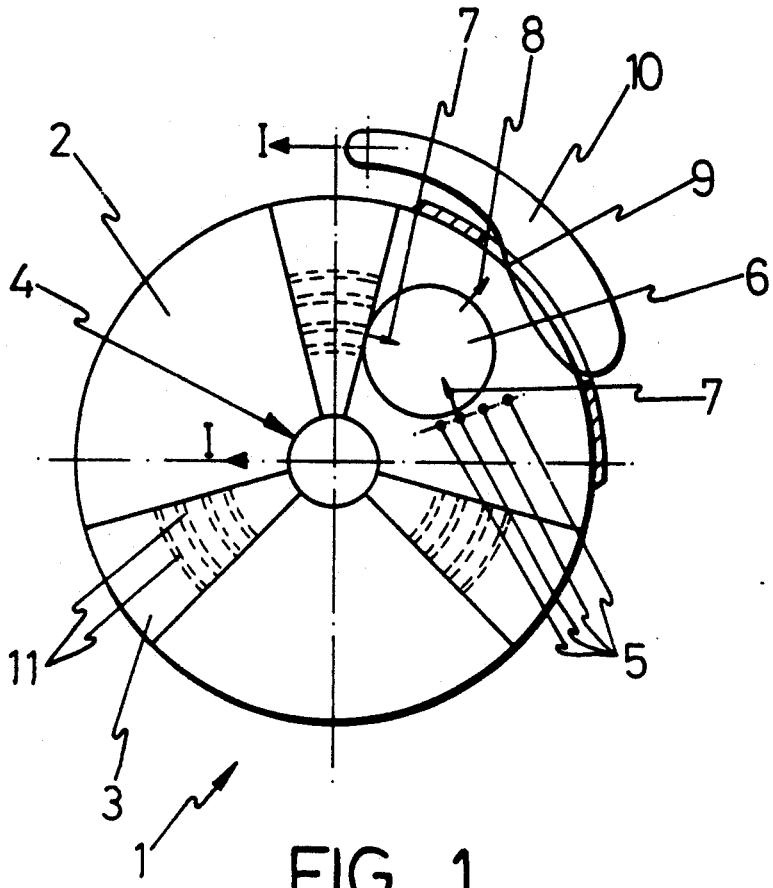
FIG. 1 shows a plan view of the returning device itself, showing the pivots that project from the fixed circular base, and the rotating body as well as the strip that obstructs the coin outlet hole.
Figure 3:
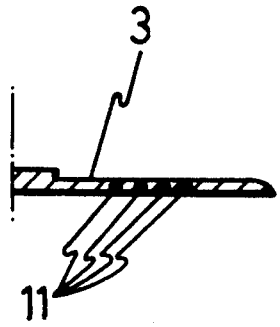
FIG. 3 it shows a sectional view according to axis I—I of FIG. 1, in which the each recess of the rotating body is positioned to received one of the pivots projecting from the fixed base.
Figure 2:
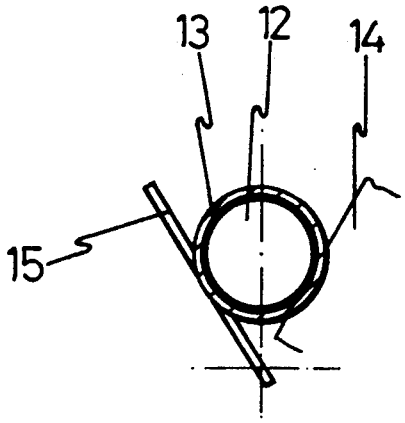
FIG. 2 shows a plan view of one embodiment in which the body of stacked coins remains vertical and the bottom coin remains close to a projection upon which it knocks against.
Figure 4:
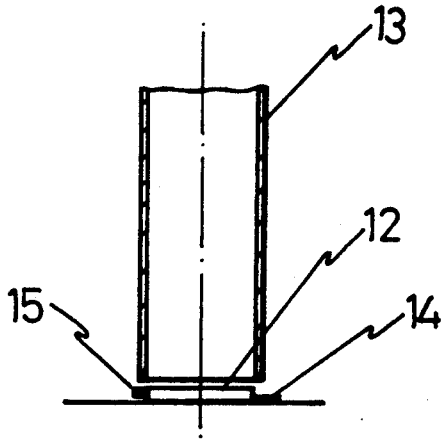
FIG. 4 it shows a sectional view, according to a vertical plane of FIG. 2, in which one sees the projection upon which the lowest coin of the vertical column remains.

In view of the commented figures, and in accordance with the numbering used, we can see how the returning device itself (1) consists of a fixed circular having some pivots 5 projecting therefrom and a rotating body (4) provided with some blades (3). When the body rotates on the fixed circular base (2), blades 3 knock the coins 6 against pivots 5 causing their removal.

Upon the body (4) rotating, the blades (3) of the same press the coins (6) that knock against the pivots (5), in such a way that the the distance between the contact points where the coin is pressed is smaller than the diameter of the coin. Accordingly the stresses (7) acting on the coin, give a resultant force (8) that makes the coin drop from the hopper through a side hole (9) that can be obstructed by a strip (10). The strip 10 is urged by the action of a spring that impels it towards the inside of the hopper to obstruct the hole 9.

The rotating body can have different shapes. It can be a radial, diametric or star-shaped strip with a variable number of tips or blades.

For the counting of coins, the strip (10) can be connected to a counter or any other conventional device.

Likewise, the rotating body (4) is provided on the bottom surface of their blades with some recesses (11) each of which is positioned to receive one of pivots (5) projecting from the fixed base (2). This permits normal rotation of the body 4 which in turn drives the coins outside.

The described returning device, used in rotating returning devices can, likewise, be used in fixed vertical column returning devices wherein the coins are stacked. Thus, the bottom coin (12) of the fixed column (13) knocks against a projection (14) so that when rotating strip (15) presses upon said coin (12), the distance between the contact the contact points where the coin is pressed is smaller than the coin's diameter. This impels the coin towards the outside, producing its return.

The rotating movement of the strip (15) can be replaced by linear displacement of said strip, obtaining the same effect upon the coin.

In order to allow normal rotation of the strip (15) it passes over the projection (14) upon rotating once the coin has been ejected.

When the projections 14 and the strip 15 contact and press against a coin, the distance between the contact points is smaller than the diameter thereof whereby no matter how small the diameter of the coin is, it will always be removed.

In this way, the use of the described coin counter and return device permits the return and counting of all types of coins, irrespective of the dimensions thereof, without any modification of the same.

Thus, if the rotating returning device is to be used to return a coin value, where the coins to be counted have differing dimensions, the returning device will remove all coins without distinguishing the dimensions thereof.

Likewise, if it is desired to count coins of the same value and dimension or of different values and dimensions it suffices to introduce them all in the hopper of the returning device and the latter will remove them, counting them all together.

The device (1) incorporates in the event that jamming takes place, a return impulse upon the rotating body (4), which, after a certain amount of time, makes the jam disappear and permits subsequent normal operation of the returning device.

What is claimed:

1. A coin counter and return device, of the type used in automatic vending machines, amusement machines and slot machines, to return coins of any dimension to a user, comprising:

a fixed base having an inclined top surface;

a rotating body mounted on said top surface for rotation with respect thereto, said rotating body having at least one contacting face for impelling a coin lying on said top surface at a first contact point thereon, said first contact point being located on a first side of a reference line between the center of rotation of said rotating body and the center of the coin;

a plurality of fixed projections on said top surface positioned to contact the coin at further contact points thereon on the side of said reference line opposite said first side, the distance between said first contact point and each of said further contact points being less than the diameter of the coin, whereby coins of any dimension pressed between said first contact point and any of said further contact points are directed by a resultant force for counting and returning the coins to the user; and said rotating body having a bottom surface disposed in spaced opposed relation to said top surface, said bottom surface having a plurality of recesses each positioned to receive one of said projections as said body rotates.

2. A coin counter and return device as in claim 1, further comprising a strip mounted on said base in a position so that it is contacted by coins directed by said resultant force.

3. A coin counter and return device as in claim 1, further comprising retraction impulse means coupled to said rotating body for returning a coin jammed between said contact face and said projections.

4. A coin counter and return device as in claim 1, wherein the returning device is supplied by a vertical column supply tube containing stacked coins no greater in diameter than the inside diameter of said tube and wherein all of said stacked coins are counted and returned.

* * * * *